US005490673A

United States Patent [19]

Hiraoka

[11] Patent Number: 5,490,673

[45] Date of Patent: Feb. 13, 1996

[54] GOLF BALL

[75] Inventor: Hidenori Hiraoka, Kobe, Japan

[73] Assignee: Sumitomo Rubber Industries, Ltd., Hyogo, Japan

[21] Appl. No.: 243,786

[22] Filed: May 17, 1994

[30] Foreign Application Priority Data

May 20, 1993 [JP] Japan ..... 5-142908

[51] Int. Cl.[6] ..... A63B 37/12

[52] U.S. Cl. ..... 273/220; 273/235 R

[58] Field of Search ..... 273/220, 230, 273/235 R, 218, 62

[56] References Cited

U.S. PATENT DOCUMENTS 5,184,828 2/1993 Kim et al. ..... 273/230 X 5,304,608 4/1994 Yabuki et al. ..... 273/230 X

FOREIGN PATENT DOCUMENTS 0589647 3/1994 European Pat. Off. .

OTHER PUBLICATIONS

Database WPI, Section Ch, Week 8526, Derwent Publications Ltd., AN–157367 & JP–A–60 090 575.

*Primary Examiner*—George J. Marlo

*Attorney, Agent, or Firm*—Birch, Stewart, Kolasch & Birch

[57] ABSTRACT

Disclosed is a golf ball having an excellent (soft) hit feeling and excellent durability, which is suitable for use on the driving range. The golf ball has a two-layer structure including a core and a cover for coating the core. A compressive strain of the core is 2.8 to 3.8 mm. A hardness distribution of the core (measured by a JIS-C type hardness tester) is adjusted to 65 to 79 at the center, 70 to 80 at the location which is 5 mm away from the center to the surface, 73 to 80 at the location which is 10 mm away from the center to the surface, 75 to 82 at the location which is 15 mm away from the center to the surface and 70 to 85 at the surface, and a difference in hardness between adjacent locations of the measurement is within 5. The cover contains an ionomer resin as a main material and a stiffness of the cover is 1400 to 3000 kg/cm$^2$. The golf ball has a ball compression that is 70 to 100 (PGA system).

4 Claims, 1 Drawing Sheet

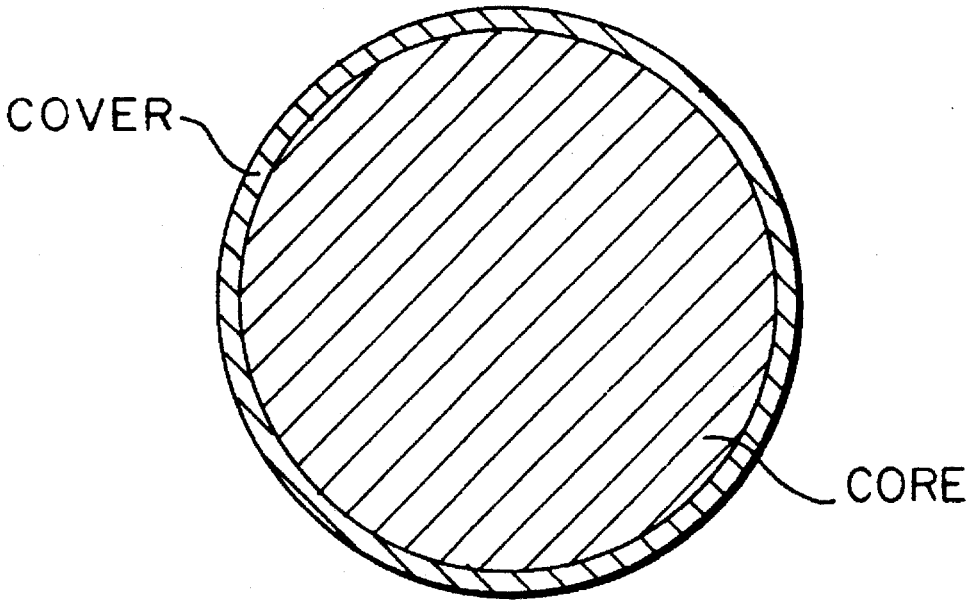
COVER
CORE

GOLF BALL

FIELD OF THE INVENTION

The present invention relates to a golf ball having a two-layer structure comprising a core and a cover for covering the core (two-piece golf ball), which is particularly suitable for use in driving ranges.

BACKGROUND OF THE INVENTION

Heretofore, a one-piece type golf ball has exclusively been used as golf balls used in driving ranges in consideration of its durability. However, there was a problem that the one-piece golf ball was extremely inferior regarding flight performance and the feeling when it was hit in comparison with a golf ball for a round of golf.

Of course, a golfer desires to use the golf ball designed for a round of golf at driving ranges. A thread wound golf ball (a golf ball obtained by winding a thread rubber on a center and covering the resulting thread rubber layer with a cover) is extremely superior with regard to the feeling when it is hit, but is extremely inferior in durability and further is expensive. Therefore, the thread wound golf ball is not suitable as a golf ball used in driving ranges.

Further, the golf ball for a round of golf having a two-piece structure in which a solid core is covered with a cover is too rigid to be hit lots of times and, therefore, normal practice can not be conducted. Therefore, this golf ball is not also suitable for use in driving ranges.

Therefore, a trial has been conducted for softening the core to cushion the shock upon impact. However, even if the core is softened, the durability becomes inferior because the difference in hardness between the cover and the core is large. Therefore, this type of ball is also not suitable for practical use.

As described above, a conventional golf ball for practice is inferior regarding flight performance and the feeling when it is hit in comparison with a golf ball for a round of gold and the type of golf ball for a round is inferior in durability and is too rigid to hit lots of times. Therefore, they are not suitable as golf balls used in driving ranges.

BRIEF DESCRIPTION OF THE DRAWING

The sole FIGURE illustrates an embodiment of a golf ball of the present invention having a core and a cover.

SUMMARY OF THE INVENTION

The main object of the present invention is to provide a golf ball having excellent hit feeling and durability, which is particularly suitable for use as a golf ball at driving ranges.

These objects as well as other objects and advantages of the present invention will become apparent to those skilled in the art from the following description.

The present invention provides a golf ball having a two-layer structure comprising a core and a cover for covering the core; a compressive strain of said core being 2.8 to 3.8 mm; a hardness distribution of said core (measured by a JIS-C type hardness tester) being adjusted to 65 to 79 at the center of the core, 70 to 80 at the location which is 5 mm away from the center to the surface, 73 to 80 at the location which is 10 mm away from the center to the surface, 75 to 82 at the location which is 15 mm away from the center to the surface and 70 to 85 at the surface and a difference in hardness between adjacent locations of measurement being within 5; said cover containing an ionomer resin as a main material and a stiffness of said cover being 1400 to 3000 kg/cm$^2$; and the ball having a ball compression of 70 to 100 (PGA system).

DETAILED DESCRIPTION OF THE INVENTION

That is, according to the present invention, a golf ball having soft hit feeling and excellent durability which is particularly suitable for using in driving ranges is obtained by using an ionomer resin as a main material of a cover and decreasing a stiffness of the cover to 1400 to 3000 kg/cm$^2$ smaller than that of the cover used for a normal golf ball for a round of golf to soften the cover; increasing a compressive strain of a core to 2.8 to 3.8 mm larger than that of a normal core to soften the core so as to adapt to the soft cover; and limiting a hardness distribution of the core to a specific one as described above and decreasing a ball compression to 70 to 100 (PGA) to soften the entire golf ball in comparison with a normal golf ball for a round.

In the present invention, the compressive strain of the core is 2.8 to 3.8 mm. When the compressive strain of the core is smaller than 2.8 mm, the core becomes too rigid, which results in an inferior hit feeling. When the compressive strain of the core is larger than 3.8 mm, the core becomes too soft, which results in inferior durability.

In the present invention, the hardness distribution of the core (measured by a JIS-C type hardness tester) is adjusted to 65 to 79 at the center, 70 to 80 at the location which is 5 mm away from the center to the surface, 73 to 80 at the location which is 10 mm away from the center to the surface, 75 to 82 at the location which is 15 mm away from the center to the surface and 70 to 85 at the surface, and a difference in hardness between adjacent locations of measurement is within 5. By adjusting the hardness distribution of the core as described above, the compressive strain of the core can be moderately maintained, which results in a good hit feeling.

When the hardness measured at each location of measurement is higher than that in the above hardness distribution, the compressive strain of the core becomes small, which results in an inferior hit feeling. When the hardness measured at each location of measurement is lower than that in the above hardness distribution, the compressive strain of the core becomes large, which results in an inferior hit feeling and durability. By adjusting the difference in hardness between adjacent locations of measurement within 5, a golf ball having excellent durability and hit feeling can be obtained.

The hardness of the interior of the core can be measured by cutting the core into hemispherical pieces, followed by measuring the hardness at the above specific location of measurement.

The center, the location which is 5 mm away from the center to the surface, the location which is 10 mm away from the center to the surface, and the location which is 15 mm away from the center to the surface and surface (which are normally employed as the location of measurement in case of determination of the hardness distribution of the core) are selected for determination of the hardness distribution of the core, because the hardness distribution can not be given unless the location of measurement is not specified.

In the golf ball of the present invention, the core consists of a single layer and the hardness thereof varies continuously. On the other hand, in a core having a multi-layer structure, the hardness varies discontinuously with the layers.

The core having different hardness distribution in the single layer structure as described above can be obtained by selecting a vulcanizing agent and vulcanizing condition.

In the present invention, the hardness is defined as that measured by a JIS-C type hardness tester. The JIS-C type hardness tester is a spring type hardness tester (C type) according to JIS K 6301 (procedure of physical test of vulcanized rubber).

The stiffness of the cover is 1400 to 3000 kg/cm$^2$ in the present invention. When the stiffness is smaller than 1400 kg/cm$^2$, a scratch is liable to be formed on the surface of the cover. When the stiffness is larger than 3000 kg/cm$^2$, the durability becomes inferior.

In the present invention, the ball compression is 70 to 100 (PGA system), preferably 70 to 95 (PGA system). When the ball compression is smaller than 70 (PGA system), the durability of the golf ball is deteriorated. When the ball compression is larger than 100 (PGA system), the hit feeling becomes rigid (not soft).

The core having the above characteristics consists of a vulcanized product of a rubber composition. As a rubber component of the rubber composition, for example, butadiene rubber having a cis-1,4-structure (base rubber) is suitable. The rubber component may be those in which other rubbers such as natural rubber, styrene-butadiene rubber, isoprene rubber, chloroprene rubber, butyl rubber, ethylene-propylene rubber, ethylene-propylene-diene rubber, acrylonitrile, etc. are blended with the above butadiene rubber in an amount of not more than 40 parts by weight based on 100 part by weight of the rubber component.

As the vulcanizing agent, there can be used those which are normally used as the vulcanizing agent, for example, metal salts of α, β-ethylenicallly unsaturated carboxylic acids obtained by reacting α, β-ethylenicallly unsaturated carboxylic acids such as acrylic acid and methacrylic acid with metal oxides such as zinc oxide in the preparation of the rubber composition, metal salts (normal salt or basic salt) of α, β-ethylenicallly unsaturated carboxylic acids such as zinc acrylate and zinc methacrylate, polyfunctional monomers, N,N-phenylbismaleimide, sulfur and the like. Among them, metal salts (particularly, zinc salt) of α, β-ethylenicallly unsaturated carboxylic acids are particularly preferred.

The amount of the vulcanizing agent is preferably 20 to 40 parts by weight (in case of metal salts of α, β-ethylenicallly unsaturated carboxylic acids) based on 100 parts by weight of the rubber component. When α, β-ethylenicallly unsaturated carboxylic acids are reacted with metal oxides in the preparation of the rubber composition, the amount of α, β-ethylenicallly unsaturated carboxylic acids is preferably 15 to 30 parts by weight and the amount of metal oxides such as zinc oxide is preferably 15 to 35 parts by weight, based on 100 parts by weight of the rubber component.

As the filler, for example, there can be used at least one sort of inorganic powders such as barium sulfate, calcium carbonate, clay, zinc oxide and the like. The amount of the filler is preferably 5 to 50 parts by weight based on 100 parts by weight of the rubber component.

A suitable amount of a softening agent and liquid rubber may be formulated for the purpose of improving workability or adjusting a hardness. Further, a suitable amount of an antioxidant may be formulated for the purpose of preventing aging.

As the vulcanization accelerator, for example, there can be used organic peroxides such as dicumyl peroxide, 1,1-bis(t-butyl peroxy)3,3,5-trimethylcyclohexane and the like. The amount of the vulcanization accelerator is preferably 0.1 to 5 parts by weight, particularly 0.3 to 3 parts by weight, based on 100 parts by weight of the rubber component.

In the preparation of the core, crosslinkage due to sulfur is not necessarily required for vulcanization of the rubber composition. Therefore, it is considered to be relevant to express by the term "crosslinking" rather than "vulcanization". In the present specification, however, we expressed by the term "vulcanization" in accordance with the precedents.

In the preparation of the core, the above formulation materials are mixed using a roll, kneader, Banbury, etc. and the mixture is vulcanized at 145° to 200° C., preferably 150° to 175° C. under pressure for 10 to 40 minutes using a mold. In order to improve adhesion of the resulting core to the cover, an adhesive may be applied on the surface thereof or the surface may be roughened.

The cover contains an ionomer resin as a main material and the stiffness is adjusted to 1400 to 3000 kg/cm$^2$ by blending at least one ionomer resin. In addition to the ionomer resin, titanium oxide ($TiO_2$), light stabilizers, colorants, antioxidants and the like may be formulated, if necessary. Further, a part of the ionomer resin may be substituted with other polymers such as polyethylene, polyamide and the like unless properties of the ionomer resin (e.g. excellent cut resistance, etc.) are not damaged.

As the cover of the normal golf ball such as golf ball for round, ionomer resins such as Hi-milane #1605, Hi-milane #1705, Hi-milane #1706 (trade name, manufactured by Mitsui Du Pont Polychemical Co.) are sometimes used in combination. However, it is sometimes difficult to adjust the stiffness in the range of 1400 to 3000 kg/cm$^2$ by only using these ionomer resins. In the present invention, it is preferred to adjust the stiffness in the range of 1400 to 3000 kg/cm$^2$ using an ionomer resin having low stiffness such as Hi-milane #1855 (trade name, manufactured by Mitsui Du Pont Polychemical Co., stiffness of 917 k/cm$^2$).

The cover having the above stiffness is soft in comparison with the cover used for the golf ball for a round of golf. By using the soft cover, the hit feeling becomes soft and the cover adapts to the softened core to prevent deterioration of the durability due to mismatching of the cover and core, which results in excellent durability. When using the soft cover, the durability is deteriorated due to mismatching of the cover and core if the core is soft. In the present invention, since the core is also softened, the durability is not deteriorated. In the present invention, the soft hit feeling is considered to be good because it is suitable for hitting a lot of golf balls.

Hi-milane (trade name) manufactured by Mitsui Du Pont Polychemical Co. was given as the ionomer resin, however, the ionomer resin is not limited to a specific one, for example, there can also be used those which are commercially available under the trade name of ESCOR and IOTEK manufactured by Exxon Chemical Co. In the blending of the above ionomer resins, those obtained by neutralizing with a sodium ion may be blended with those obtained by neutralizing with a zinc ion. It is preferred that those obtained by neutralizing with a zinc ion are blended each other.

When the core is coated with the above cover, an injection molding method is normally used, however, it is not limited to a specific method, for example, coating may be conducted by a molding method after preparing a half-shell. The thickness of the cover is not specifically limited, and it is normally 1.4 to 2.7 mm. In case of cover molding, dimples may be formed, if necessary. Further, if necessary, a paint or marking may be applied after cover molding.

EXAMPLES

The following Examples and Comparative Examples further illustrate the present invention in detail but are not to be construed to limit the scope thereof.

TABLE 1

| | Example 1 | Example 2 | Example 3 | Example 4 |
|---|---|---|---|---|
| Butadiene rubber *1 | 100 | 100 | 100 | 100 |
| Zinc acrylate | 0 | 0 | 0 | 30 |
| Zinc oxide | 30.5 | 30.5 | 30.5 | 20 |
| Antioxidant *2 | 0.2 | 0.2 | 0.2 | 0.25 |
| Methacrylic acid | 18 | 18 | 18 | 0 |
| Dicumyl peroxide | 1.4 | 1.8 | 1.8 | 2.0 |
| Vulcanizing condition (°C. × minutes) | 155 × 30 | 155 × 25 | 155 × 25 | 160 × 20 |
| Physical properties of core | | | | |
| Weight (g) | 35.2 | 35.2 | 35.2 | 35.2 |
| Compressive strain (mm) | 3.5 | 3.1 | 3.1 | 3.2 |
| Hardness distribution (JIS-C) | | | | |
| Center | 68 | 74 | 74 | 67 |
| Location which is 5 mm away from the center | 70 | 76 | 76 | 70 |
| Location which is 10 mm away from the center | 73 | 77 | 77 | 73 |
| Location which is 15 mm away from the center | 75 | 79 | 79 | 78 |
| Surface | 73.5 | 76.5 | 76.5 | 83 |

Examples 1 to 4 and Comparative Examples 1 to 3

The formulation components shown in Tables 1 and 2 were kneaded to prepare rubber compositions for core of Examples 1 to 4 and Comparative Examples 1 to 3. After forming into a sheet, the rubber sheet was placed in a mold and subjected to a vulcanization molding in a press under conditions shown in Tables 1 and 2 to prepare a core of 34.8 mm in diameter. The amount of each component in Tables 1 and 2 is "parts by weight".

The weight, the compressive strain and the hardness distribution of the core thus obtained were measured. The results are shown in Tables 1 and 2.

The formulation, vulcanizing conditions and physical properties of core as to Examples 1 to 4 are shown in Table 1. Those as to Comparative Examples 1 to 3 are shown in Table 2. Further, details of formulation components in Tables 1 and 2 are described behind Table 2.

The measuring method of the compressive strain and the hardness distribution of the core is as follows.

Compressive strain:

An initial load (10 kg) is applied on the core, and then a final load (130 kg) is applied. The amount of deformation (mm) formed between initial loading and final loading is measured as the compressive strain. The larger the value is, the softer the core.

Hardness distribution:

The hardness was measured at the center of the core, locations which are respectively 5 mm, 10 mm and 15 mm away from the center to the surface of the core and the surface of the core, using a JIS-C type hardness tester. The larger the value is, the more rigid the core. The hardness of the core is measured after cutting the core into hemispherical pieces.

TABLE 2

| | Comparative Example 1 | Comparative Example 2 | Comparative Example 3 |
|---|---|---|---|
| Butadiene rubber *1 | 100 | 100 | 100 |
| Zinc acrylate | 0 | 0 | 0 |
| Zinc oxide | 30.5 | 28.7 | 29.2 |
| Antioxidant *2 | 0.2 | 0.25 | 0.2 |
| Methacrylic acid | 18 | 24 | 21 |
| Dicumyl peroxide | 1.4 | 1.5 | 1.5 |
| Vulcanizing condition (°C. × minutes) | 155 × 35 | 170 × 22 | 175 × 32 |
| Physical properties of core | | | |
| Weight (g) | 35.2 | 35.1 | 35.2 |
| Compressive strain (mm) | 3.5 | 2.4 | 3.1 |
| Hardness distribution (JIS-C) | | | |
| Center | 68 | 73 | 64 |
| Location which is 5 mm away from the center | 70 | 75 | 67 |
| Location which is 10 mm away from the center | 71 | 80 | 71 |
| Location which is 15 mm away from the center | 74 | 84 | 73 |
| Surface | 73.5 | 86 | 80 |

Details of components formulated:

*1: BR11 (trade name), high-cispolybutadiene manufactured by Nippon Gosei Gomu Co., Ltd.

TABLE 2-continued

| | Comparative Example 1 | Comparative Example 2 | Comparative Example 3 |
|---|---|---|---|

*2: Noklac NS-6 (trade name), manufactured by Ouchi Shinko Kagaku Kogyo Co, Ltd.

Then, a cover composition was prepared according to the formulation shown in Table 3, and the stiffness thereof was measured. The results are shown in Table 3. The amount of the formulation component is "parts by weight" and the measuring method of the stiffness is as follows.

Stiffness:

A cover composition is subjected to a press molding to prepare a plate specimen, which is allowed to stand at a temperature of 23° C. and a relative humidity of 50% for two weeks and the stiffness is measured by a stiffness meter manufactured by Toyo Seiki Co., Ltd.

The cover formulation, the weight, the compression, the durability and the hit feeling of the resulting golf ball as to Examples 1 to 4 are shown in Table 4. Those as to Comparative Examples 1 to 4 are shown in Table 5.

The measuring method of the compression, the durability and the hit feeling shown in Tables 4 and 5 is as follows.

Compression (ball compression):

It is conducted according to PGA system. The larger the value is, the more rigid the golf ball.

Durability:

A golf ball was struck against a metal plate at a speed of 45 m/second by an air gun, and the number of times until the golf ball was broken was measured. The resulting value was indicated as an index in case of the value of the golf ball of Example 3 being 100. The larger the value is, the better the durability.

Hit feeling:

A total of one hundred golfers of two professional golfers and ninety-eight amateur golfers actually hit the golf ball on the driving range and the hit feeling was evaluated in the following criteria: good (soft), ordinary and inferior (rigid).

TABLE 4

| Formulation of cover | Example 1 A | Example 2 A | Example 3 B | Example 4 A |
|---|---|---|---|---|
| Physical properties of ball | | | | |
| Weight (g) | 45.3 | 45.4 | 45.4 | 45.5 |
| Compression | 73 | 90 | 86 | 87 |
| Durability | 98 | 99 | 100 | 97 |
| Hit feeling | | | | |
| Good (soft) | 95 | 88 | 91 | 87 |
| Ordinary | 5 | 11 | 9 | 13 |
| Inferior (rigid) | 0 | 1 | 0 | 0 |

TABLE 3

| | Formulation of cover | | |
|---|---|---|---|
| | A | B | C |
| Himilane #1855 *3 | 15 | 50 | 0 |
| Himilane #1705 *4 | 25 | 20 | 10 |
| Himilane #1706 *5 | 60 | 30 | 90 |
| Titanium oxide ($TiO_2$) | 1.0 | 1.0 | 1.0 |
| Stiffness (kg/cm$^2$) | 2400 | 1600 | 3200 |

Details of component formulated

*3: Trade name, ionomer resin obtained by neutralizing with a zinc ion manufactured by Mitsui Du Pont Polychemical Co., stiffness of 917 kg/cm$^2$

*4: Trade name, ionomer resin obtained by neutralizing with a zinc ion manufactured by Mitsui Du Pont Polychemical Co., stiffness of 2350 kg/cm$^2$

*5: Trade name, ionomer resin obtained by neutralizing with a zinc ion manufactured by Mitsui Du Pont Polychemical Co., stiffness of 3360 kg/cm$^2$

TABLE 5

| Formulation of cover | Comparative Example 1 C | Comparative Example 2 A | Comparative Example 3 C |
|---|---|---|---|
| Physical properties of ball | | | |
| Weight (g) | 45.3 | 45.2 | 45.2 |
| Compression | 79 | 106 | 98 |
| Durability | 51 | 97 | 61 |
| Hit feeling | | | |
| Good (soft) | 41 | 0 | 0 |
| Ordinary | 59 | 8 | 19 |
| Inferior (rigid) | 0 | 92 | 81 |

As shown in Table 3, formulations A and B of the cover belong to the present invention because the stiffness thereof is in the range of 1400 to 3000 kg/cm$^2$. However, the formulation C is not included in the present invention because the stiffness thereof exceeds 3000 kg/cm$^2$.

Then, a core was coated with a cover according to the manner as shown in Tables 4 and 5 to prepare a golf ball of 42.7 in diameter. The coating of the cover on the core was conducted at a temperature of 230° C. by an injection molding method.

As to the resulting golf ball, the weight, the compression, the durability and the hit feeling were determined. The results are shown in Tables 4 and 5.

As is shown in Table 4, the gold balls of Examples 1 to 4 of the present invention were superior in hit feeling and durability.

On the other hand, as shown in Table 5, the golf balls of Comparative Examples 1 to 3 are inferior in hit feeling and/or durability. That is, the golf ball of Comparative Example 1 having high stiffness of the cover is inferior in durability, and the golf ball of Comparative Example 2 having low compressive strain of the core is inferior in hit feeling. The hardness of the core measured at each location of measurement is low in comparison with the present invention. The golf ball of Comparative Example 3 having high stiffness of the cover is inferior in both hit feeling and durability.

As described above, according to the present invention, there can be provided a golf ball having excellent hit feeling and durability which is suitable as a golf ball used in the driving range by softening the cover and further softening the core so as to adapt to the soft cover.

What is claimed is:

1. A golf ball having a two-layer structure comprising:

a core; and a cover for coating the core;

wherein said core has a compressive strain of 2.8 to 3.8 mm, said compressive strain being the amount of deformation occurring between application of an initial load of 10 kg and a final load of 130 kg;

wherein said core has a hardness distribution measured by a JIS-C type hardness tester adjusted to (a) 65 to 79 at the center of said core, (b) 70 to 80 at a location which is 5 mm away from the center to the surface of said core, (c) 73 to 80 at a location which is 10 mm away from the center to the surface, (d) 75 to 82 at a location which is 15 mm away from the center to the surface, and (e) 70 to 85 at the surface, with the difference in hardness between adjacent locations of measurement (a), (b), (c), (d) and (e) being within 5;

wherein said cover contains an ionomer resin as a main material and has a stiffness of 1400 to 3000 kg/cm$^2$; and wherein said golf ball has a ball compression of 70 to 100.

2. The golf ball of claim 1, wherein said core comprises a vulcanized rubber composition, wherein said rubber composition contains a rubber component having butadiene rubber and not more than 40 parts by weight of another rubber selected from the group consisting of natural rubber, styrene-butadiene rubber, isoprene rubber, chloroprene rubber, butyl rubber, ethylene-propylene rubber, ethylene-propylene-diene rubber and acrylonitrile based on 100 parts by weight of the rubber component; and filler in an amount of 5 to 50 parts by weight based on 100 parts by weight of the rubber component.

3. The golf ball of claim 2, wherein said cover has a thickness of from 1.4 to 2.7 mm.

4. The golf ball of claim 1, wherein said cover has a thickness of from 1.4 to 2.7 mm.

* * * * *